United States Patent [19]

Walton et al.

[11] Patent Number: 4,748,923

[45] Date of Patent: Jun. 7, 1988

[54] METHOD AND APPARATUS FOR AUTOMATED LOADING OF APPAREL SEGMENTS TO A GARMENT ASSEMBLY MACHINE AND THE LIKE

[75] Inventors: Richard R. Walton, 10 West Hill Pl., Boston, Mass. 02111; George E. Munchbach, Roslindale, Mass.

[73] Assignee: Richard R. Walton, Boston, Mass.

[21] Appl. No.: 850,800

[22] Filed: Apr. 11, 1986

[51] Int. Cl.[4] ..... D05B 21/00

[52] U.S. Cl. ..... 112/121.12; 112/121.29; 271/131; 198/459; 198/468.4; 198/468.9

[58] Field of Search ..... 271/91, 99, 104, 105, 271/151, 166, 167, 183, 131, 132, 133; 198/459, 461, 468.4, 468.6, 468.9; 414/127, 128; 112/121.12, 121.15, 121.29, 304, 320

[56] References Cited

U.S. PATENT DOCUMENTS

| | | | |
|---|---|---|---|
| 1,649,319 | 11/1927 | Molyneux | 271/30.1 |
| 2,127,714 | 8/1938 | Belluche | 271/151 X |
| 2,878,016 | 3/1959 | Russell et al. | 271/11 |
| 3,126,201 | 3/1964 | Rehm | 271/32 |
| 3,168,308 | 2/1965 | Walton et al. | 271/27 |
| 3,386,763 | 6/1968 | Ottaway et al. | 271/26 |
| 3,531,103 | 9/1970 | Walton | 294/681 |
| 3,539,177 | 11/1970 | Schwenk et al. | 271/33 |
| 3,588,091 | 6/1971 | Stone et al. | 271/19 |
| 3,773,319 | 11/1973 | Hottendorf et al. | 271/151 |
| 4,010,945 | 3/1977 | Kistner | 271/151 |
| 4,046,369 | 9/1977 | Kluge et al. | 271/151 X |
| 4,401,044 | 8/1983 | Bowditch | 112/262.3 |
| 4,457,243 | 7/1984 | Bowditch | 112/121.14 |
| 4,512,269 | 4/1985 | Bowditch | 112/121.12 |
| 4,524,706 | 6/1985 | Bell | 112/121.29 |
| 4,638,749 | 1/1987 | Wood | 112/121.29 X |

OTHER PUBLICATIONS

Murray, Dec. 1975, *AAMA Apparel Research Journal*, p. 87, Single Ply Pick-Up Devices.

Fabri-Feed, (USM Fabric Feeder Model UFFM, Advertisement).

*Primary Examiner*—Joseph E. Valenza

*Assistant Examiner*—Jonathan D. Holmes

[57] ABSTRACT

A method of automated garment assembly includes providing a shingled array of limp garment segments on a movable conveyor with the leading portion of the forwardmost segment exposed for contact by the segment transfer device, and subjecting the array to conditions promoting separation of the forwardmost segment from the array without disturbance of the alignment of the remaining segments in the array and simultaneously engaging the forwardmost segment with the segment transfer device and displacing it from the array to a segment processing station. Apparatus for performing the method are also described.

15 Claims, 2 Drawing Sheets

METHOD AND APPARATUS FOR AUTOMATED LOADING OF APPAREL SEGMENTS TO A GARMENT ASSEMBLY MACHINE AND THE LIKE

This invention relates to methods and apparatus useful in the automated making of garments and particularly concerns the loading and feeding of limp garment segments to automated sewing and garment assembly equipment.

The subject matter of this application may be employed with automated garment forming machines such as shown in U.S. Pat. No. 4,401,044, entitled "System and Method for Manufacturing Seamed Articles", U.S. Pat. No. 4,457,243, entitled "Automated Seam Joining Apparatus", and U.S. Pat. No. 4,512,269, entitled "Automated Assembly System for Seamed Articles", all incorporated herein by reference.

In the making of garments there are occasions when it is desired to repeatedly deliver to the automated assembly equipment an individual segment, for instance, a sleeve or a sleeve part, from a supply of pieces which vary from piece to piece. For instance, the pieces are usually limp and porous and may vary in surface texture, from slick to very rough, or there may be variation in thickness, adornment or attachment of supplemental pieces. Such variations can make automated feeding very difficult and present problems to the designer of machines for automated garment production. Such problems are made even more difficult when it is desired to match and feed pairs of pieces from a supply as a single "segment".

According to the invention it is found that significant economies and assurance of proper operation can be achieved by arranging the limp and porous pieces in a shingled or lapped array on a movable conveyor and then providing means permitting the forwardmost piece to be withdrawn without disturbing the arrangement of the succeeding pieces in the array.

According to one aspect of the invention, a method of automated garment assembly is provided which includes the steps of providing a shingled array of limp garment segments on a movable conveyor with the leading portion of the forwardmost segment exposed for contact by segment transfer means, subjecting the array to conditions promoting separation of the forwardmost segment from the array without disturbance of the alignment of the remaining segments in the array and simultaneously engaging the forwardmost segment with the segment transfer means and displacing it from the array to a segment processing station.

In one preferred embodiment of the method, the forwardmost segment has its trailing portion disposed beneath a leading portion of the next segment and the conditions promoting separation include applying vacuum to the upper surface of the segment.

In another preferred embodiment of the method, the conditions include inverting the shingled array from a shingled array-forming state in which the forwardmost segment has its trailing portion trapped against a conveyor below the next segment to an inverted condition in which the forwardmost segment has its trailing portion lying over the next segment, with its upper surface free of restraint. With porous segments it can be advantageous to blow air downwardly through the trailing portion of the forwardmost segment to loosen it from the next segment.

According to another aspect of the invention an apparatus is provided for delivering limp and variable segments of material to a further operation, which comprises a movable conveyor having a surface adapted to receive and convey a series of the segments in prearranged shingled array, the forwardmost segment having its rearward portion disposed between the next-above segment and the surface of the conveyor, and a restraint device engageable upon the upper surface of the shingled array at a position spaced rearwardly of the leading portion of the forwardmost segment, the restraint device being constructed and arranged to restrain the remainder of the array while the forwardmost segment is withdrawn from the array by tension applied to its leading free end.

In preferred embodiments of this aspect of the invention, for use with porous segments of material, the restraint device comprises a vacuum device constructed and positioned to apply suction to the upper surface of the array whereby the outer segment is drawn against the device and is restrained by frictional resistance due to such engagement and a further segment below the outer segment is restrained by its engagement with the undersurface of the outer segment due to air being drawn upwardly through the porous segments. Preferably the vacuum device is positioned rearwardly of the trailing edge of the forwardmost segment and extends in the direction crosswise to the direction of travel of the conveyor; the vacuum device is constructed and arranged to provide an upward force to at least in part relieve the forwardmost segment from restraint, thereby to facilitate withdrawal of the forwardmost segment from the array; means are provided to cause slight upward movement of the vacuum device effective to hold the outer segment in raised position while the forwardmost segment is drawn away; and transfer means are provided for engaging the leading portion of the forwardmost segment and pulling it away or otherwise transferring it from the array in the direction of travel of the conveyor.

According to another aspect of the invention, an apparatus for deliverying limp and variable segments of material to a further operation comprises a first endless movable conveyor rotatable about horizontal axes and having a surface adapted to receive and convey a series of segments in prearranged shingled array, the forwardmost segment having its rearward portion disposed between the next-above segment and the surface of the conveyor, and a second endless conveyor rotatable about horizontal axes, movable at the same speed as the first conveyor, the second conveyor having a first portion arranged to engage and confine the array of segments between the conveyors while it reverses direction, whereby the weight of the array is transferred to the second conveyor and the array is inverted, and a further portion of the second conveyor supporting the array extends beyond the first conveyor to a delivery station in which the forwardmost segment of the limp material lies above the other segments of the array, free to be lifted off the conveyor.

In preferred embodiments of this aspect of the invention for use with porous segments of material, an air blowing loosening device is provided to at least in part relieve the forwardmost segment from its engagement with the next segment. The apparatus includes transfer means for engaging the forwardmost segment and transferring it from the array. In certain advantageous embodiments the transfer means comprises an array of pick-up devices which engage and grip localized portions of the face of the segment and move together to deliver the segment. In other embodiments the transfer means is a vacuum device engageable with the leading portion of the forwardmost segment in the region in which it rests upon the conveyor and in others it is a moving gripping belt that slides the segment along a low-friction surface.

By use of the invention, human operations are only minimally required for the automated article assembly process. More particularly, a relatively low skill level operator need only select segments from a stack of pre-cut segments and establish in rapid succession a shingled stack of segments on the support surface of a conveyor. The only constraint is that the various segments be laterally offset to form the "shingled" effect. All additional orientation, such as that required by prior art systems, may be accomplished by the automated assembly device in using its vision and manipulation systems. Any necessary color or pattern sorting can also be accomplished at this time.

Moreover, by placing the sole human operation of stacking at the beginning of the assembly process, and by virtue of the ease and great speed at which this shingled stacking can be done, a highly efficient utilization of even a low skilled operator can be effected. One operator can easily, and in a very short time, establish a shingled stack for an automatic loading system with enough segments so as not to limit its throughput, and then the operator is free to assume other duties. There is no requirement for the continuous attention of a relatively highly skilled operator, as in the prior art.

The foregoing and other objects of this invention, the various features thereof, as well as the invention itself, may be more fully understood from the following description, when read together with the accompanying drawings in which.

Figure 1:
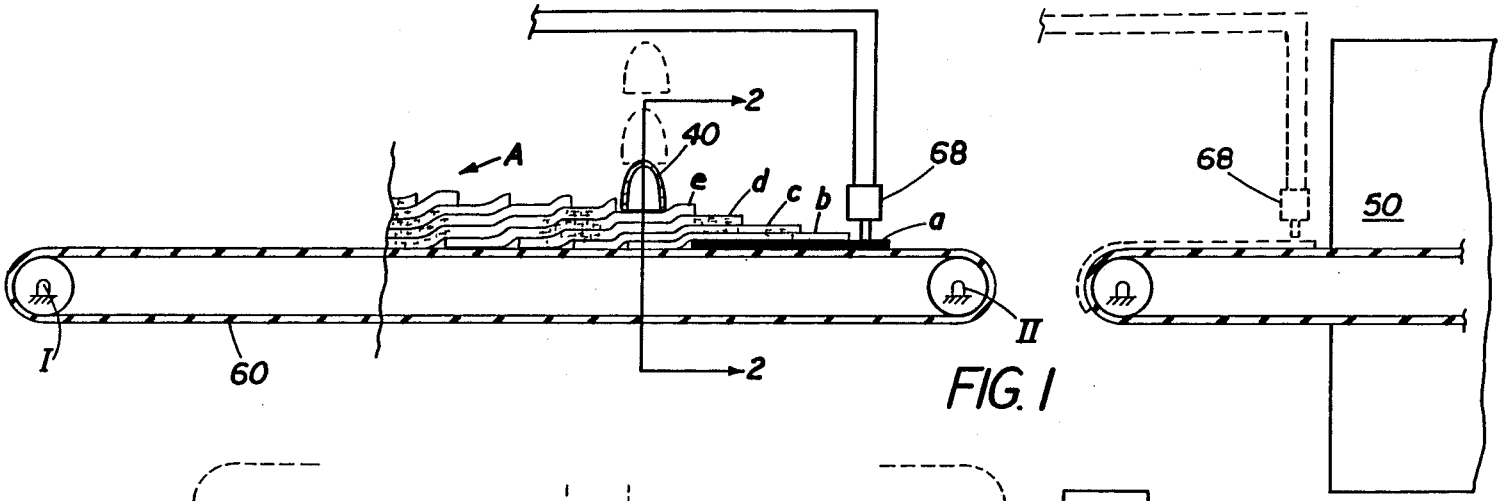
FIG. 1 is a longitudinal cross-sectional view of a first embodiment of an automated garment making machine according to the invention.

Referring to FIG. 1, an endless conveyor 60 is rotatable about fixed horizontal axes I and II. The upper portion of the conveyor defines a shingling station in which a shingled array of limp garment sections a, b, c, d, etc., is assembled; for instance, by an operator who services the shingling stations of a number of such machines. The operator may, for instance, have a jumbled supply of cut sleeve pieces and her task may be to match two pieces together and treat them as one segment in forming a shingled array.

The forwardmost segment a (shown in blackened line), rests upon the conveyor 60, the second segment b has its forward leading portion resting upon the first segment a and its trailing portion resting upon the coveyor, etc.

The conveyor 60 may have a length selected to permit an operator to form a sufficient length of shingled array to supply the automated garment assembly machine 50 for a period of time and then she may attend to another of her tasks. Meanwhile, with suitable controls, the conveyor can advance to bring successive forwardmost segments of the array to the loading station where the forwardmost segment is removed from the array.

Figure 2:
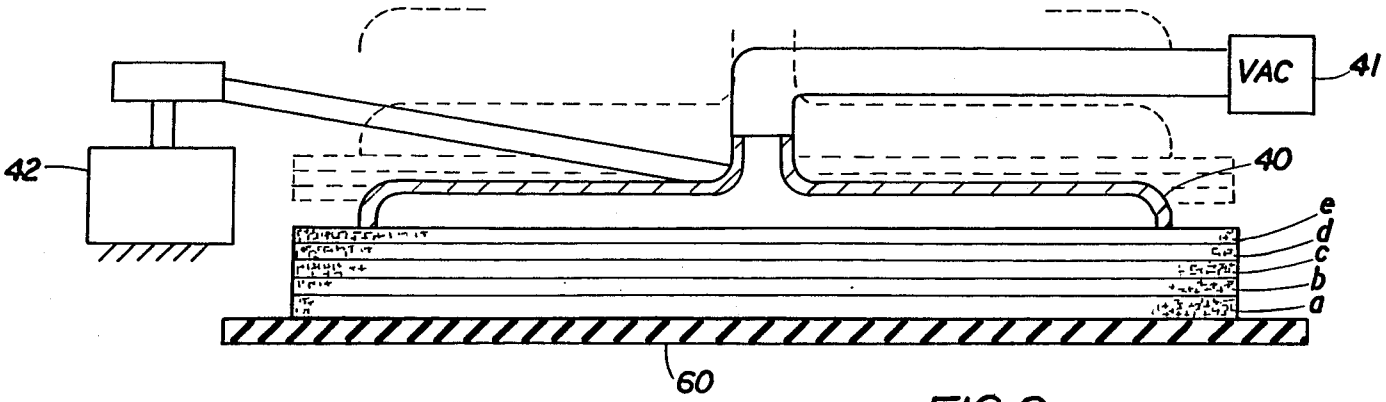
FIG. 2 is a transverse cross-sectional view taken on line 2—2 of FIG. 1.

In this embodiment the loading system includes a three position vacuum nozzle 40, connected to vacuum source 41, and associated linkage and pneumatic actuator assembly 42. The nozzle 40 and linkage and actuator assembly 42 are adapted to selectively position the nozzle 40 in a "first" position as shown in solid lines in FIGS. 1 and 2, so that its outlet is adjacent to the support surface defined by conveyor belt 60. The nozzle 40 and assembly 42 are also adapted to selectively retract the nozzle outlet to a "second" position slightly displaced (e.g. $\frac{1}{8}$ to $\frac{1}{4}$ inch) above the support surface, or to a "third" position well above the support surface as suggested by dashed lines. The position of nozzle 40 in the X direction, i.e., to the left in FIG. 1, is selected for an expected workpiece segment length, preferably so that when the leading edge of the lowermost segment is in transfer position, the nozzle 40 overlies the second lowermost segment in the stack just beyond the trailing edge of the lowermost segment.

A controller which may be a programmed digital computer, provides overall coordination and control of the above-described elements to accomplish cyclical operation of the loading system. In other forms of the invention, the control may be accomplished by the operation of a plurality of pneumatic valves in a predetermined timed sequence or as controlled by a mechanical linkage. In the presently described embodiment, initially, with actuator 42 controlling vacuum nozzle 40 to its third (i.e. uppermost) position, a shingled stack is established on the support surface.

The conveyor drive motor (not shown) then advances the position of the shingled array so that the leading edge of the lowermost segment a in the stack is in transfer position. At this point actuator 42 positions vacuum nozzle 40 to its first position. As a result, the vacuum nozzle 40 provides a lift force to the segments b, c, d and e of the stack, unweighting the lowermost segment a, the nozzle moving to its second position. Grippers 68, e.g. of the type shown in Walton and Munchbach, U.S. application Ser. No. 614,478 filed May 30, 1984 now U.S. Pat. No. 4,445,193, issued Feb. 24, 1987 (FIGS. 10–15*b* as particularly described in columns 9, 10 and 11, incorporated herein by reference), then engage the segment and transfer it to the automated assembly machine 50. At this point, actuator 42 returns nozzle 40 to its uppermost position. Then the drive motor advances the conveyor so that the now-lowermost segment, b, reaches the transfer position. The loading process may then repeat on a cyclical basis to extract the now-lowermost segment from the stack. All such extractions are performed without disturbing the integrity of limp material layers in either the extracted segment or adjacent segments. Where the vacuum nozzle 40 overlies only the single, next-to-lowermost segment when extraction of the lowermost segment is to occur, the system may be used for both porous and non-porous limp material segments, when the segments are single layered. In embodiments adapted for shingled stacks where the vacuum nozzle is positioned to overlie more than two segments, when extraction of the lowermost segment is to occur or where the segments are multilayered, the segments are preferably a porous limp material, such as a woven fabric, so that the lift force applied to those segments by the vacuum is established by the flow of air through those segments and into the nozzle.

In alternate embodiments, the vacuum nozzle 40 may be replaced with device for applying a downward force to the segments. With that configuration, too, the lowermost segment a may be extracted from the stack without disturbing the integrity of limp material in adjacent segments.

Figures 3, 4, 5, 6:
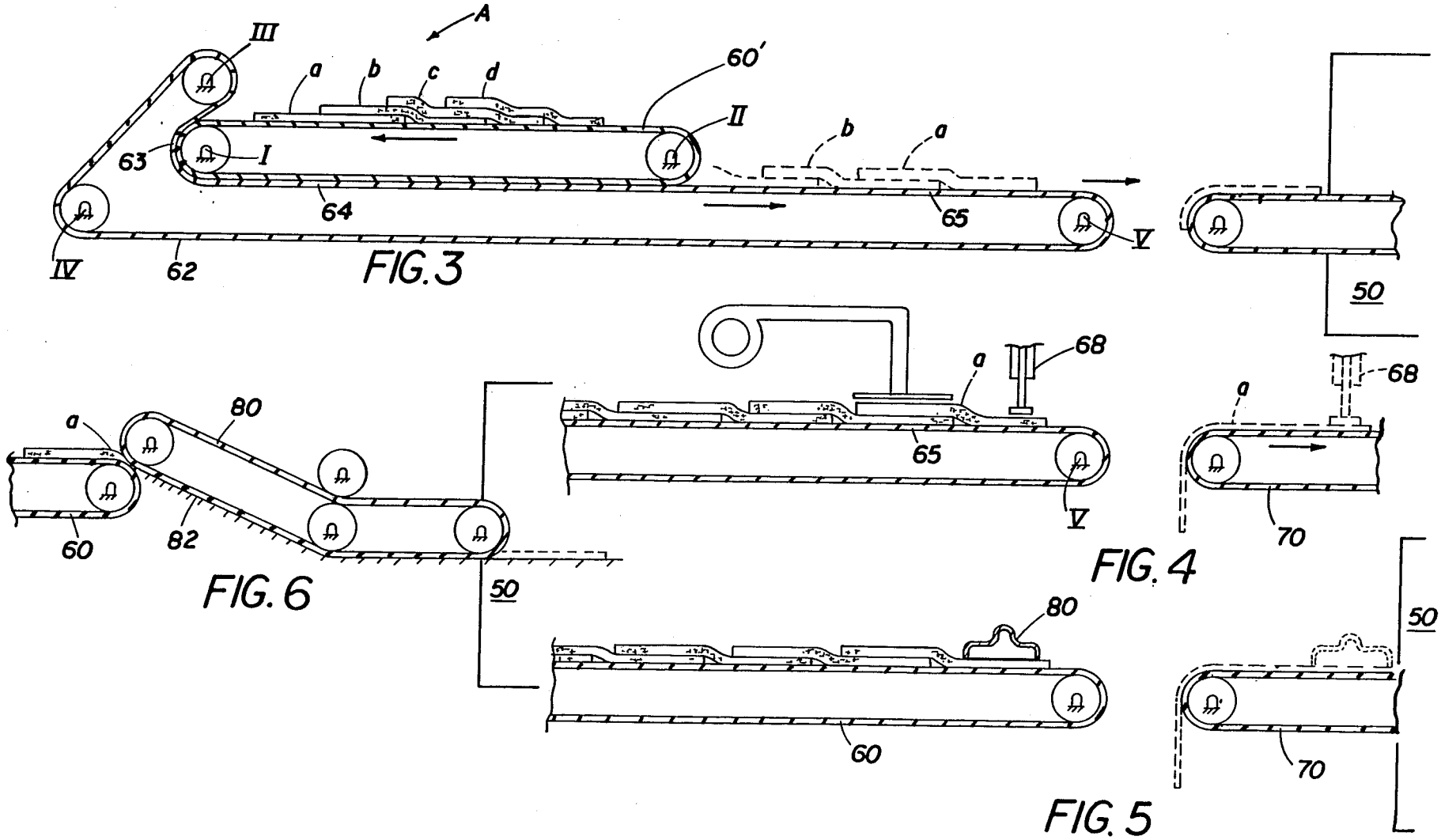
FIG. 3 is a longitudinal cross-sectional view of a second embodiment employing inversion of a shingled stack.
FIG. 4 is a cross-sectional view of parts of a machine having a blow-down loosening device and a special form of pick-up device.
FIGS. 5 and 6 are views similar to FIG. 4 of alternative segment transfer devices.

Referring to FIG. 3, a first endless conveyor 60' is rotatable about fixed horizontal axes I and II. The upper portion of the conveyor defines a shingling station in which a shingled array A of limp garment segments a, b, c and d is assembled, for instance, again by an operator who services the shingling stations of a number of such machines.

As before, the forwardmost segment a rests upon the conveyor 60', the second segment b has its forward leading portion resting upon the first segment a and its trailing portion resting upon the conveyor, etc. A second conveyor 62 is rotatable about horizontal axes I, III, IV and V. A first portion 63 of the second conveyor is engageable upon the upper surface of the array and travels with the array and a corresponding portion of the first conveyor about axis I to an inverted position in which the second conveyor takes the weight of the array. A second portion 64 of the conveyor extends beneath the first conveyor and a third portion 65 of the second conveyor extends beyond the first conveyor and provides a delivery station. As shown in dotted lines, the forwardmost segment, after progressing to the delivery station, is free at the top of the array, the leading portion of this segment lying upon conveyor portion 65 and the trailing portion of this segment lying upon the next segment b. In this position the forwardmost segment can readiy be removed by tension applied in the direction of the arrow shown in FIG. 3. In cases, for instance, where the surface texture of the segments is very rough, a loosening device, for instance, the air blow-down device shown in FIG. 1 of Walton and Munchbach U.S. Pat. No. 3,168,307, (FIG. 1 and related description (generally columns 3 and 4) incorporated herein by reference) can be employed to loosen the engagement of the forwardmost piece from the second at the time of pick up, as shown in FIG. 4. The leading portion of the forwardmost piece may be engaged and picked up, for instance, by pickup devices shown in the Walton and Munchbach application mentioned above.

Referring still to FIG. 4, the pick-up 68, after engagement upon the leading portion of forwardmost segment a, can move to the dotted line position shown in FIG. 4, carrying with it the segment a, which, in the appropriate position, is released by the pick-up to be carried away by further conveyor 70.

Referring to FIG. 5, in this case the transer device 80 is a vacuum nozzle. Since the leading edge of only the segment desired to be transferred is resting on the conveyor belt at this point (and hence no discrimination is required) the vacuum nozzle 80 can be quite effective. First, its vacuum is turned on, it grips the fabric, and then it is raised and translated to the deposit position shown in dotted lines in FIG. 5.

In FIG. 6, a dragging conveyor 80, movable at a faster speed than conveyor 60 can engage and drag away the segment when it reaches low friction slide surface 82 at the end of the conveyor.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A method of automated garment assembly including the steps of providing a shingled array of limp garment segments on a movable conveyor with the leading portion of the forwardmost segment exposed for contact by segment transfer means, subjecting said array to conditions promoting separation of said forwardmost segment from said array without disturbance of the alignment of the remaining segments in said array and simultaneously engaging said forwardmost segment with the segment transfer means and displacing it from said array to a segment processing station.

2. The method of claim 1 wherein said forwardmost segment has its trailing portion disposed beneath a leading portion of the next segment and said conditions promoting separation include the application of vacuum to the upper surface of said next segment.

3. An apparatus for delivering limp and variable segments of material to a further operation, comprising a. a movable conveyor having a surface adapted to receive and convey a series of said segments in prearranged shingled array, the forwardmost segment having its rearward portion disposed between the next-above segment and the surface of said conveyor, and b. a restraint device engageable upon the upper surface of said shingled array at a position spaced rearwardly of the leading portion of the forwardmost segment, said restraint device constructed and arranged to restrain the remainder of said array while said forwardmost segment is withdrawn from said array by tension applied to its leading free portion.

4. The apparatus of claim 3 for use with porous segments of material wherein said restraint device comprises a vacuum device constructed and positioned to apply suction to the upper surface of said array whereby the outer segment is drawn against said device and is restrained by frictional resistance due to such engagement and a further segment below the outer segment is restrained by its engagement with the undersurface of the outer segment due to air being drawn upwardly through said porous segments.

5. The apparatus of claim 4 wherein said vacuum device is positioned rearwardly of the trailing edge of said forwardmost segment and extends in the direction crosswise to the direction of travel of the conveyor.

6. The apparatus of claims 4 or 5 wherein said vacuum device is constructed and arranged to provide an upward force to at least in part relieve the forwardmost segment from restraint, thereby to facilitate the withdrawal of said forwardmost segment from said array.

7. The apparatus of claim 6 including means to cause slight upward movement of said vacuum device effective to hold said outer segment in raised position while said forwardmost segment is drawn away.

8. The apparatus of any of claims 3, 4 or 5, including transfer means for engaging the leading portion of the forwardmost segment and pulling it away from said array in the direction of travel of said conveyor.

9. A system for selectively loading the lowermost segment of a shingled stack of limp material segments to a seam joining apparatus, each segment including one or more adjacent layers of said limp material, wherein adjacent segments of said stack are longitudinally offset relative to the direction of transport by a predetermined minimum distance, comprising:

A. an endless belt transport system defining a substantially planar transport surface adapted to support said shingled stack of limp material segments thereon, said belt transport system including an associated means for driving said endless belt transport system to selectively transport said stack in the direction of a reference axis, B. detection means for detecting when the leading edge of the lowermost segment of said stack passes a reference point along said reference axis, C. selectively operable extraction means for transporting said lowermost segment in the direction of said reference axis and away from said stack and to said seam joining apparatus, D. selectively operable limit means for applying a limit force to one or more adjacent segments of said stack including the next to lowermost segment but not said lowermost segment, E. controller responsive to said detection means, said controller including means cyclically operative following the loading of a lowermost segment, for:

i. controlling the operation of said drive means in a cycle to advance said shingled stack in the direction of said reference axis until the leading edge of the current lowermost segment passes said reference point, and for maintaining said stack stationary otherwise during a cycle, ii. during a cycle following the time when said leading edge passes said reference point, controlling said limit means to apply said limit force, iii. in association with the initiation of the operation of said limit means in a cycle, controlling said extraction means to perform said transporting of said lowermost segment.

10. A system according to claim 9 wherein said limit means includes means for applying an upward force to said one or more adjacent segments.

11. A system according to claim 9 wherein said limit means includes means for applying a downward force to said one or more adjacent segments.

12. A system for selectively loading the lowermost segment of a shingled stack of limp material segments, each segment including one or more adjacent layers of said limp material, wherein adjacent segments of said stack are longitudinally offset relative to the direction of transport along a reference axis by a predetermined minimum distance, comprising:

A. substantially planar surface adapted to support said shingled stack of limp material segments thereon, in a position whereby the leading edge of said lowermost segment is adjacent to a reference point along said reference axis, B. selectively operable extraction means for transporting said lowermost segment in the direction of said reference axis and away from said stack, and wherein said extraction means are adapted to selectively grip a portion of said leading edge of said lowermost segment when said leading edge is adjacent to said reference pint.

13. A system according to claim 12 further comprising selectively operable limit means for applying a limit force to one or more adjacent segments of said stack including the next to lowermost segment but not said lowermost segment.

14. A system according to claim 13 wherein said limit means includes means for applying an upward force to said one or more adjacent segments.

15. A system according to claim 13 wherein said limit means includes means for applying a downward force to said one or more adjacent segments.

* * * * *

UNITED STATES PATENT AND TRADEMARK OFFICE

CERTIFICATE OF CORRECTION

PATENT NO. : 4,748,923

DATED : June 7, 1988

INVENTOR(S) : Richard R. Walton et al.

It is certified that error appears in the above-identified patent and that said Letters Patent is hereby corrected as shown below:

On the title page, under U. S. Patent Documents, "Walton- 294/681" should read -- Walton - 294,861 --.

Column 8, line 29, "pint" should read -- point --.

Signed and Sealed this

Twenty-second Day of November, 1988

*Attest:*

*Attesting Officer*

DONALD J. QUIGG

*Commissioner of Patents and Trademarks*